US005120892A

United States Patent [19]

Skraba

[11] Patent Number: 5,120,892

[45] Date of Patent: Jun. 9, 1992

[54] METHOD AND APPARATUS FOR PYROLYTICALLY CRACKING HYDROCARBONS

[75] Inventor: Frank W. Skraba, Sweeny, Tex.

[73] Assignee: Phillips Petroleum Company, Bartlesville, Okla.

[21] Appl. No.: 455,560

[22] Filed: Dec. 22, 1989

[51] Int. Cl.[5] ..... C07C 4/02

[52] U.S. Cl. ..... 585/652; 585/648; 585/649; 585/650; 208/125; 208/130

[58] Field of Search ..... 585/649, 650, 652; 208/130

[56] References Cited

U.S. PATENT DOCUMENTS

| | | | |
|---|---|---|---|
| 3,674,890 | 7/1972 | Oleszko et al. | 260/683 |
| 3,793,389 | 2/1974 | Oleszko et al. | 260/679 |
| 3,862,898 | 1/1975 | Boyd et al. | 208/73 |
| 3,980,525 | 9/1976 | Knell | 585/650 |
| 4,107,226 | 8/1978 | Ennis, Jr. et al. | 208/130 |
| 4,361,478 | 10/1982 | Geagler | 208/130 |
| 4,479,869 | 10/1984 | Petterson et al. | 208/130 |
| 4,617,109 | 10/1986 | Wells et al. | 208/130 |
| 4,684,759 | 8/1987 | Lum | 585/650 |
| 4,726,893 | 2/1988 | Funk et al. | 208/130 |
| 4,940,828 | 7/1990 | Petterson et al. | 585/464 |

FOREIGN PATENT DOCUMENTS

| | | |
|---|---|---|
| 679194 | 9/1952 | United Kingdom . |
| 998504 | 7/1965 | United Kingdom . |
| 1335802 | 10/1973 | United Kingdom . |

OTHER PUBLICATIONS

Phillips 66 Company Drawing No. P-7087D entitled "1.3 BILLION PPY ETHYLENE PROPANE FEEDSTOCK PROCESS FLOW DIAGRAM PYROLYSIS FURNACES".

Detailed drawing having the hand-written designation Drawing No. 2.

S. B. Zodnik, E. J. Green, L. P. Hallee, "Function of dilution steam in cracking," Manufacturing Ethylene, Petroleum Publishing Co. 1970 pp. 65-68.

S. B. Zodnik, E. J. Green, L. P. Hallee, "Cracking-furnace design," Manufacturing Ethylene, Petroleum Publishing Co., 1970, pp. 69-71.

Bailey, T. et al., "Ethylene Furnace Design." Chemical Engineering Progress, Jul. 1978, pp. 45-50.

*Primary Examiner*—Helane Myers

*Attorney, Agent, or Firm*—Laney, Dougherty, Hessin & Beavers

[57] ABSTRACT

The present invention provides a method and an apparatus for pyrolytically cracking a hydrocarbon vapor feedstock. The hydrocarbon vapor feedstock is contacted with water prior to cracking. While the hydrocarbon vapor feedstock is being contacted with water, both the feedstock and the water are heated by indirect heat exchange with at least one process stream containing waste heat. Consequently, a portion of the water vaporizes and combines with the hydrocarbon vapor feedstock. The hydrocarbon vapor feedstock is subsequently cracked in the presence of the vaporized water.

11 Claims, 2 Drawing Sheets

METHOD AND APPARATUS FOR PYROLYTICALLY CRACKING HYDROCARBONS

BACKGROUND OF THE INVENTION

1. Field of the Invention

The present invention relates generally to a method and apparatus for pyrolytically cracking hydrocarbons. In another aspect, the present invention relates to a method for providing diluent steam for hydrocarbon pyrolysis.

2. Description of the Prior Art

Diluent steam is added to a hydrocarbon pyrolysis feedstock prior to the introduction of the feedstock into the cracking section of a pyrolysis furnace. The presence of diluent steam in the pyrolysis furnace lowers the partial pressure of the hydrocarbon feedstock and improves product yields by promoting higher selectively for the formation of desired olefinic products. One method of diluent steam addition has involved the direct injection of steam into the hydrocarbon feedstock. Another method of diluent steam addition has involved the injection of water into the hydrocarbon feedstock. The water is subsequently vaporized by preheating the water/feedstock mixture in the convection section of the pyrolysis furnace.

In these past methods, the amount of diluent steam addition has been limited by the fuel costs required to generate the diluent steam. The heat required to produce the diluent steam has been provided, for example, by the burning of fuel in a boiler or by the burning of additional fuel in the pyrolysis furnace.

The present invention utilizes waste heat to generate diluent stream for a pyrolysis feedstock. Consequently, the present invention reduces diluent steam generation costs. Further, the present invention allows for the economical use of greater quantities of diluent steam in order to achieve improved product yields.

SUMMARY OF THE INVENTION

The present invention provides a method for pyrolytically cracking a hydrocarbon vapor feedstock. In the method of the present invention, the hydrocarbon vapor feedstock is contacted with water. As contacting occurs, both the hydrocarbon vapor feedstock and the water are heated by indirect heat exchange with at least one process stream which contains waste heat. This contacting and heating causes a portion of the water to vaporize and combine with the hydrocarbon vapor feedstock. Unvaporized water is separated from the hydrocarbon vapor feedstock and the vaporized water. In the presence of the vaporized water, the hydrocarbon vapor feedstock is then cracked in a pyrolysis furnace to produce a furnace effluent stream comprising cracked feedstock and vaporized water.

In a preferred embodiment of the method, a recycle water stream is used for contacting the hydrocarbon vapor feedstock. In this embodiment, the furnace effluent stream is quenched with quench water in order to cool the cracked feedstock and the vaporized water and in order to condense at least a portion of the vaporized water. The quench water and the condensed water are separated from the cracked feedstock and from any water with remains vaporized. A portion of the quench water and a portion of the condensed water are then combined with the unvaporized water which was earlier separated from the hydrocarbon vapor feedstock.

This combined water stream is then utilized for contacting the hydrocarbon vapor feedstock.

The present invention also provides an apparatus for pyrolytically cracking a hydrocarbon vapor feedstock. The apparatus of the present invention includes a contacting means for contacting the hydrocarbon vapor feedstock with water. Heat exchanging means, for heating the hydrocarbon vapor feedstock and water by indirect heat exchange with at least one process stream containing waste heat, are disposed within the contacting means. The hydrocarbon vapor feedstock and water are contacted and heated in the contacting means in order to vaporize a portion of the water and combine the vaporized water with the hydrocarbon vapor feedstock. The apparatus also includes a pyrolysis furnace for cracking the hydrocarbon vapor feedstock in the presence of the vaporized water. The hydrocarbon vapor feedstock is cracked in the pyrolysis furnace in order to produce a cracked feedstock. A conduit means is provided for conducting the hydrocarbon vapor feedstock and vaporized water from the contacting means to the pyrolysis furnace.

A preferred embodiment of the apparatus provides the ability to use recycled water for contacting the hydrocarbon vapor feedstock. In the preferred embodiment, the apparatus further comprises a combined quenching and condensing means for quenching the cracked feedstock and the vaporized water with quench water in order to cool the cracked feedstock and the vaporized water and in order to condense at least a portion of the vaporized water. A second conduit means is provided for conducting the cracked feedstock and vaporized water from the pyrolysis furnace to the quenching and condensing means. Additionally, means are provided for forming a combined water stream by combining the water remaining unvaporized in the contacting means, a portion of the condensed water, and a portion of the quench water. The preferred embodiment also comprises a third conduit means for conducting the combined water stream to the contacting means where the combined water stream is used to contact the hydrocarbon vapor feedstock.

It is therefore a general object of the present invention to provide a method and an apparatus for pyrolytically cracking a hydrocarbon vapor feedstock.

A further object of the present invention is the provision of an economical method and apparatus for generating diluent steam and for adding the diluent steam to a hydrocarbon pyrolysis feedstock.

Other and further objects, features and advantages of the present invention will be readily apparent to those skilled in the art upon reference to the accompanying drawings and upon a reading of the description of the preferred embodiments which follows.

DETAILED DESCRIPTION OF THE PREFERRED EMBODIMENTS

Figure 1:
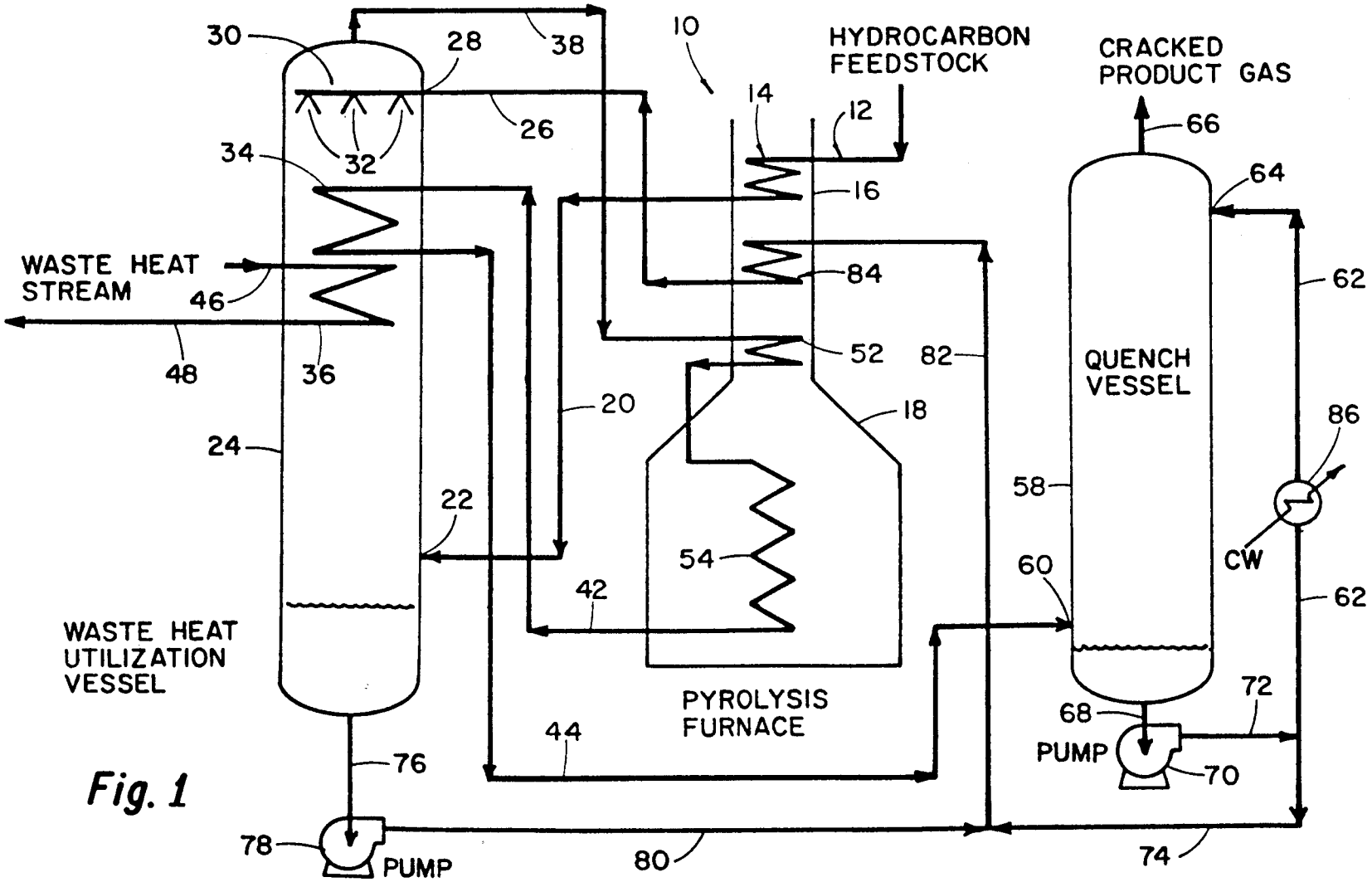
FIG. 1 schematically illustrates an embodiment of the apparatus of the present invention wherein the furnace effluent stream is utilized for heating the contents of the waste heat utilization vessel.

Referring to FIG. 1, an embodiment of the apparatus of the present invention is illustrated and generally designated by the numeral 10. FIG. 1 illustrates a portion of a hydrocarbon pyrolysis unit. A hydrocarbon vapor feedstock is conducted to a feedstock preheating coil 14 by a conduit 12 which is connected thereto. The feedstock preheating coil 14 is located in the convection section 16 of pyrolysis furnace 18. Conduit 12 is connected to a source (not shown) of hydrocarbon vapor feedstock. The hydrocarbon vapor feedstock is heated in feedstock preheating coil 14 by hot flue gas which flows through the convection section 16 of pyrolysis furnace 18. The preheated hydrocarbon vapor feedstock is conducted from feedstock preheating coil 14 by conduit 20 which is connected thereto.

The hydrocarbon vapor feedstock is conducted by conduit 20 to a waste heat utilization vessel 24. Conduit 20 is connected to a hydrocarbon vapor feedstock inlet 22 located at the lower portion of waste heat utilization vessel 24. Upon entering waste heat utilization vessel 24, the hydrocarbon vapor feedstock flows toward the top of vessel 24.

Water is conducted to waste heat utilization vessel 24 by a conduit 26 which is connected to a water inlet 28 located at the upper portion of vessel 24. Water distributor 30 is connected to water inlet 28 and is disposed within waste heat utilization vessel 24. Water distributor 30 distributes the water within waste heat utilization vessel 24. After distribution by water distributor 30, the water gravitationally falls toward the bottom of waste heat utilization vessel 24.

While other types of liquid distributors known in the art would be suitable for distributing water within waste heat utilization vessel 24, FIG. 1 shows water distributor 30 as comprising a set of spray nozzles 32. One or more spray nozzles can be used to achieve sufficient water distribution in waste heat utilization vessel 24.

As the hydrocarbon vapor feedstock flows toward the top of waste heat utilization vessel 24, it is contacted with the water which is falling toward the bottom of waste heat utilization vessel 24. The hydrocarbon vapor feedstock and water also contact, and are heated by, furnace effluent exchanger 34 and waste heat exchanger 36 which are disposed within waste heat utilization vessel 24. Due to the unsaturated nature of the hydrocarbon feedstock, the reduced partial pressure of water existing in waste heat utilization vessel 24, and the heat supplied by furnace effluent exchanger 34 and waste heat exchanger 36, a portion of the water introduced into waste heat utilization vessel 24 vaporizes and combines with the hydrocarbon vapor feedstock. The hydrocarbon vapor feedstock and vaporized water combined therewith are conducted out of waste heat utilization vessel 24 by conduit 38 which is connected to the top of waste heat utilization vessel 24. The water which is not vaporized in waste heat utilization vessel 24 accumulates at the bottom of vessel 24.

Furnace effluent is conducted to the hot side of furnace effluent exchanger 34 by conduit 42 which is connected to the inlet thereof. Exchangers (not shown) can also be disposed within conduit 42 for cooling the furnace effluent stream before the furnace effluent stream arrives at furnace effluent exchanger 34. For example, the furnace effluent stream can be used to generate steam before being used for indirect heat exchange in furnace effluent exchanger 34.

As the furnace effluent stream travels through the hot side of furnace effluent exchanger 34, the furnace effluent stream heats the hydrocarbon vapor feedstock and water in waste heat utilization vessel 24 by indirect heat exchange. The furnace effluent is conducted out of furnace effluent exchanger 34 by conduit 44 which is connected to the outlet thereof.

A process stream containing waste heat is conducted to the hot side of waste heat exchanger 36 by conduit 46 which is connected to the inlet thereof. Conduit 46 is also connected to a source (not shown) from which the process stream containing waste heat is obtained. As the process stream containing waste heat travels through the hot side of waste heat exchanger 36, the process stream containing waste heat heats the hydrocarbon vapor feedstock and water in waste heat utilization vessel 24 by indirect heat exchange. The process stream is conducted out of waste heat exchanger 36 by conduit 48 which is connected to the outlet thereof. Conduit 48 conducts the process stream to a process stream return point (not shown).

The process stream containing waste heat can come from within the hydrocarbon pyrolysis unit, from a process unit located elsewhere in the plant, or from a utility system. Although it is not required, the waste heat stream will typically have a low temperature so that the heat contained in the stream cannot be more economically recovered elsewhere in the plant. Examples of process streams containing waste heat include a discharge stream from a cracked gas compressor, a discharge stream from a refrigerant compressor, surplus low pressure steam, warm flue gas, process streams going to storage, etc.

The amount of water vaporized and combined with the hydrocarbon vapor feedstock in waste heat utilization vessel 24 can be controlled by a conventional temperature controller (not shown). For example, the temperature of the hydrocarbon vapor feedstock and water combined therewith flowing through conduit 38 can be controlled by adjusting the flow rate of the process stream flowing through the hot side of waste heat exchanger 36.

Conduit 38 conducts the hydrocarbon vapor feedstock and vaporized water combined therewith from waste heat utilization vessel 24 to pyrolysis furnace 18. Conduit 38 is connected to the inlet of saturated feedstock preheating coil 52. The hydrocarbon vapor feedstock and vaporized water combined therewith travel through saturated feedstock preheating coil 52 and into the pyrolysis furnace cracking section 54 which is connected to saturated feedstock preheating coil 52. In the preheating coil 52, the feedstock is heated to a temperature just below the feedstock's cracking temperature. In the cracking section 54, the hydrocarbon vapor feedstock is cracked in the presence of the vaporized water. The resulting cracked feedstock and vaporized water combined therewith form the furnace effluent stream referred to above. The furnace effluent stream is conducted out of pyrolysis furnace 18 by conduit 42 which is connected to the outlet of cracking section 54.

After the furnace effluent stream travels through furnace effluent exchanger 34 and heats the contents of waste heat utilization vessel 24, conduit 44 conducts the furnace effluent stream to quench vessel 58. Conduit 44 is connected to the cracked feedstock inlet 60 of quench vessel 58. Quench water is conducted to quench vessel 58 by conduit 62 which is connected to the quench water inlet 64 located at the upper portion of quench vessel 58. The quench water falls toward the bottom of quench vessel 58 so that the quench water contacts the furnace effluent as the furnace effluent flows toward the top of quench vessel 58. The quench water cools the cracked feedstock and vaporized water and condenses at least a portion of the vaporized water. The quench water and condensed water accumulate in the bottom of quench vessel 58. The cracked feedstock and the vaporized water which is not condensed in quench vessel 58 are conducted out of quench vessel 58 by conduit 66 which is connected to the top of quench vessel 58. Conduit 66 conducts the cracked feedstock and vaporized water to a product recovery system (not shown) where desired products are recovered from the cracked feedstock.

The water which accumulates in the bottom of quench vessel 58 is conducted to pump 70 by conduit 68. Conduit 68 is connected to the bottom of quench vessel 58 and to the inlet of pump 70. Conduit 72 is connected to the discharge of pump 70 and to conduits 62 and 74. A conventional flow control apparatus (not shown) is provided to regulate the division of water into conduits 62 and 74. The water directed through conduit 62 is recirculated quench water which is conducted to the quench water inlet 64 of quench vessel 58. Cooling water exchanger 86 is disposed within conduit 62 for cooling the recirculated quench water with cooling water prior to introduction of the recirculated quench water into quench vessel 58. Other exchangers (not shown) can also be disposed within conduit 62 to recover heat from the recirculated quench water.

Unvaporized water which accumulates in the bottom of waste heat utilization vessel 24 is conducted to pump 78 by conduit 76. Conduit 76 is connected to the bottom of waste heat utilization vessel 24 and to the inlet of pump 78. The unvaporized water is conducted from pump 78 to conduit 82 by conduit 80. Conduit 80 is connected to the discharge of pump 78 and to conduit 82. Conduit 74 is also connected to conduit 82 so that the quench water and condensed water which was not recirculated to the quench vessel 58 is combined with the unvaporized water from waste heat utilization vessel 24. This combined water stream is conducted to water preheating coil 84, which is located in the convection section 16 of pyrolysis furnace 18, by conduit 82 which is connected to the inlet of water preheating coil 84. The combined water stream is heated in water preheating coil 84 by the hot flue gas that flows through the convection section 16 of pyrolysis furnace 18. The combined water stream is conducted out of the water preheating coil 84 by conduit 26 which is connected to the outlet of water preheating coil 84. Conduit 26 conducts the combined water stream to waste heat utilization vessel 24 where the combined water stream is used for contacting the hydrocarbon vapor feedstock.

In apparatus 10, a single waste heat exchanger 36 is disposed within waste heat utilization vessel 24 beneath furnace effluent exchanger 34. Although only one waste heat exchanger 36 is shown in apparatus 10, a plurality of waste heat exchangers can be disposed within waste heat utilization vessel 24. Alternatively, the waste heat utilization vessel 24 can contain a furnace effluent exchanger 34 and no waste heat exchangers 36.

The exchangers disposed within waste heat utilization vessel 24, including furnace effluent exchanger 34, can be positioned in vessel 24 according to the approach temperatures of the process streams flowing through the hot sides of the exchangers. Preferably, each exchanger is positioned in waste heat utilization vessel 24 above all other exchangers which have a lower process stream approach temperature. Consequently, the exchanger having the highest process stream approach temperature would be located above all of the other exchangers while the exchanger having the lowest process stream approach temperature would be located below all of the other exchangers.

Many types of exchanger designs are known in the art and would be suitable for use within waste heat utilization vessel 24. For example, stab-in type heat exchangers with finned tube bundles could be used. If the tube bundles of the stab-in exchangers do not cover the entire cross-section of the waste heat utilization vessel 24, baffles (not shown) can be used to prevent channeling and to direct hydrocarbon vapor feedstock and water flow through the exchangers. Finned exchangers having concentric or spiraling circular tube arrangements can also be used. By covering the entire cross-section of waste heat utilization vessel 24, such a circular arrangement would prevent channeling and would facilitate contact between the hydrocarbon vapor feedstock, the water, and the finned surface of the heat exchanger. As another example, plate-type exchangers might also be used in waste heat utilization vessel 24.

Make-up water (not shown) is added to the quench water system to compensate for the water vapor which leaves the system through conduit 66 and to compensate for any quench water blow down (not shown). Quench water is blown down to a sewer (not shown) as needed to prevent the excessive accumulation of contaminants.

A separator (not shown) is provided to prevent the build up of green oil and soot in the quench water system. This separator is located in conduit 72.

Figure 2:
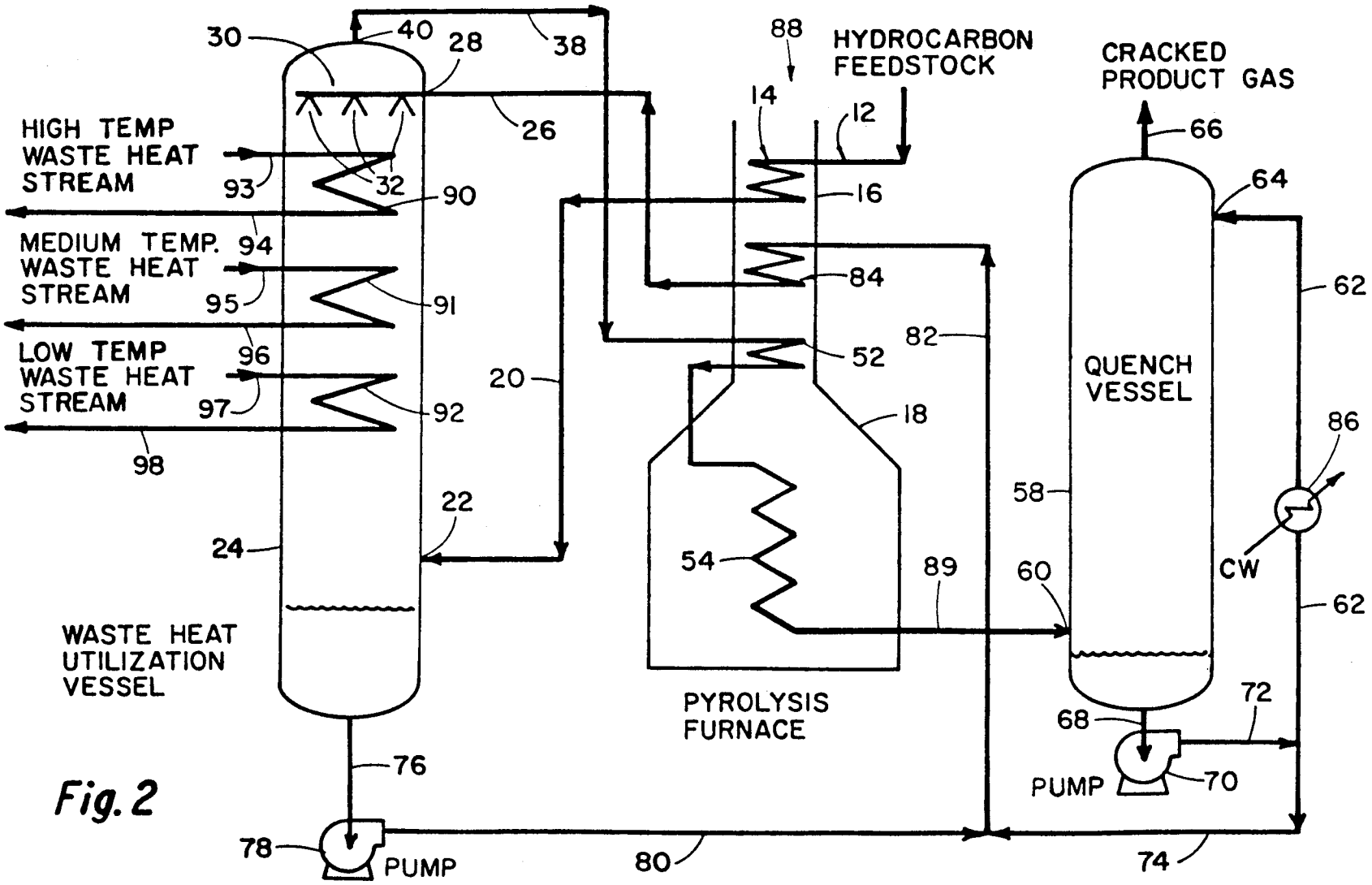
FIG. 2 schematically illustrates another embodiment of the apparatus of the present invention wherein various process streams containing waste heat are utilized for heating the contents of the waste heat utilization vessel.

FIG. 2 illustrates another embodiment of the apparatus of the present invention which is generally designated by the numeral 88. In apparatus 88, conduit 89 directly conducts furnace effluent from the cracking section 54 of pyrolysis furnace 18 to quench vessel 58. Conduit 89 is connected to the outlet of cracking section 54 and to the cracked feedstock inlet 60 of quench vessel 58. Heat exchangers (not shown) can be disposed within conduit 89 for recovering heat from the furnace effluent stream before the furnace effluent stream is conducted to quench vessel 58. For example, the furnace effluent could be used to generate steam before being conducted to quench vessel 58.

Three waste heat exchangers, 90, 91 and 92, are disposed within the waste heat utilization vessel 24 of apparatus 88. A high temperature process stream containing waste heat is conducted from a source (not shown) to high temperature waste heat exchanger 90 by conduit 93 which is connected to the inlet of exchanger 90. The high temperature process stream is cooled in exchanger 90 and is returned to a process stream return point (not shown) by conduit 94 which is connected to the outlet of exchanger 90. A medium temperature process stream containing waste heat is conducted from a source (not shown) to medium temperature waste heat exchanger 91 by conduit 95 which is connected to the inlet of exchanger 91. Medium temperature waste heat exchanger 91 is disposed within waste heat utilization vessel 24 beneath high temperature waste heat exchanger 90. The medium temperature process stream is cooled in exchanger 91 and is returned to a process stream return point (not shown) by conduit 96 which is connected to the outlet of exchanger 91. A low temperature waste heat stream is conducted from a source (not shown) to low temperature waste heat exchanger 92 by conduit 97 which is connected to the inlet of exchanger 92. Low temperature waste heat exchanger 92 is disposed within waste heat utilization vessel 24 beneath medium temperature waste heat exchanger 91. The low temperature process stream is cooled in exchanger 92 and is returned to a process stream return point (not shown) by conduit 98 which is connected to the outlet of exchanger 92.

Although three waste heat exchangers are disposed within the waste heat utilization vessel 24 of apparatus 88, one or a plurality of waste heat exchangers could be used. The exchangers disposed in waste heat utilization vessel 24 can be positioned in vessel 24 according to the approach temperatures of the process streams flowing through the hot sides of the exchangers. Preferably, each exchanger is positioned in waste heat utilization vessel 24 above all other exchangers which have a lower process stream approach temperature. Consequently, the exchanger having the highest process stream approach temperature would be located above all of the other exchangers while the exchanger having the lowest process stream approach temperature would be located below all of the other exchangers.

In the operation of the apparatus of the present invention, a hydrocarbon vapor feedstock is preheated in the feedstock preheating coil 14 of pyrolysis furnace 18. The preheated hydrocarbon vapor feedstock is introduced into the lower portion of waste heat utilization vessel 24 so that the hydrocarbon vapor feedstock flows toward the top of waste heat utilization vessel 24. Water is introduced into the upper portion of waste heat utilization vessel 24 and distributed therein so that the water contacts the hydrocarbon vapor feedstock as the water gravitationally falls toward the bottom of waste heat utilization vessel 24.

While the water contacts the hydrocarbon vapor feedstock, both the water and the hydrocarbon vapor feedstock are heated by indirect heat exchange with one or more process streams containing waste heat. Examples of process streams containing waste heat which could be used for indirect heat exchange include: the furnace effluent stream from the cracking section 54 of pyrolysis furnace 18; other process streams from within the hydrocarbon pyrolysis unit; process streams from units located elsewhere in the plant; and streams from utility systems. Indirect heat exchange is accomplished by conducting the waste heat streams through one or more heat exchangers disposed within waste heat utilization vessel 24.

Due to the unsaturated nature of the hydrocarbon vapor feedstock, the reduced steam partial pressure existing in waste heat utilization vessel 24, and the heat obtained from indirect heat exchange with the process stream(s) containing waste heat, a portion of the water in waste heat utilization vessel 24 vaporizes and combines with the hydrocarbon vapor feedstock. Water which remains unvaporized in waste heat utilization vessel 24 separates from the hydrocarbon vapor feedstock and the vaporized water by falling to the bottom of waste heat utilization vessel 24.

The hydrocarbon vapor feedstock and the vaporized water combined therewith are conducted to pyrolysis furnace 18 wherein the combined stream is preheated and the hydrocarbon feedstock is cracked in the presence of the vaporized water. The cracked feedstock and the vaporized water combined therewith form a furnace effluent stream.

The furnace effluent stream is quenched with quench water in quench vessel 58 in order to cool the cracked feedstock and the vaporized water and in order to condense at least a portion of the vaporized water. Prior to quenching, however, the furnace effluent stream can be used for indirect heat exchange in waste heat utilization vessel 24. Using the furnace effluent stream for indirect heat exchange will allow the use of a smaller quench vessel 58, reduce quench system cooling water requirements, and reduce the amount of furnace effluent heat lost to cooling water.

The quench water and the water condensed in the quench vessel 58 separate from the cracked feedstock and the water remaining vaporized in quench vessel 58 by falling to the bottom of quench vessel 58. A portion of the quench water and condensed water accumulating in the bottom of quench vessel 58 is cooled and recirculated to quench vessel 58 as quench water. Another portion of the water accumulating in the bottom of quench vessel 58 is combined with the unvaporized water which has accumulated in the bottom of waste heat utilization vessel 24. This combined water stream is preheated in the water preheating coil 84 of pyrolysis furnace 18. The preheated combined water stream is then conducted to waste heat utilization vessel 24 where it is utilized for contacting the hydrocarbon vapor feedstock.

Examples of pyrolysis units wherein the apparatus and method of the present invention can be utilized include ethylene units which crack ethane, propane, ethane/propane, butane, or natural gas condensate feedstocks.

The following example is provided in order to further illustrate the present invention.

EXAMPLE

A 272,330 pound per hour stream of ethane feedstock is preheated to 280° F. in the feedstock preheating coil 14 of pyrolysis furnace 18. This preheated ethane feedstock stream is introduced into the bottom portion of waste heat utilization vessel 24. Waste heat utilization vessel 24 operates at 60 psia.

A stream of 130,420 pounds per hour of quench water and condensed water is taken from the bottom of quench vessel 58 at a temperature of 120° F. The water from quench vessel 58 is combined with a 100,000 pound per hour stream of 120° F. unvaporized water taken from the bottom of waste heat utilization vessel 24. The resulting combined water stream is preheated to 280° in the water preheating coil 84 of pyrolysis furnace 18. The preheated combined water stream is then introduced into the upper portion of waste heat utilization vessel 24.

As the preheated water falls toward the bottom of waste heat utilization vessel 24, it contacts the preheated ethane feedstock which is flowing toward the top of vessel 24. While the preheated water contacts the preheated ethane feedstock, the water and ethane feedstock are heated by indirect heat exchange with the furnace effluent stream which flows from the cracking section 54 of pyrolysis furnace 18.

120,600,000 BTUs per hour are transferred from the furnace effluent to the ethane feedstock and water in waste heat utilization vessel 24. Consequently, 130,420 pounds per hour of water, or 0.8. moles of water per mole of ethane feedstock, are vaporized and combined with the ethane feedstock in waste heat utilization vessel 24. The ethane feedstock and vaporized water combined therewith are conducted from waste heat utilization vessel 24 at a temperature of 280° F.

The ethane feedstock and vaporized water combined therewith are conducted to pyrolysis furnace 18 where they are preheated in saturated feedstock preheating coil 52. The ethane feedstock is then cracked in the presence of the vaporized water to form the furnace effluent stream mentioned above. The furnace effluent stream is comprises of the cracked ethane feedstock and the vaporized water.

The furnace effluent stream leaves the cracking section 54 of pyrolysis furnace 18 at a temperature of 1550° F. Before using the furnace effluent stream for indirect heat exchange in the waste heat utilization vessel 24, the furnace effluent is cooled to 350° by using the furnace effluent for steam generation.

After indirect heat exchange in waste heat utilization vessel 24, the furnace effluent is conducted to quench vessel 58 where the furnace effluent stream is quenched with 100° F. quench water. The cracked ethane feedstock and the vaporized water which is not condensed in quench vessel 58 are conducted from the top of quench vessel 58 at a temperature of 105° F.

The product yields which are obtained from the cracked ethane feedstock are provided in Table 1. Table 1 also provides the product yields which would be obtained using only 0.3 moles of diluent steam per mole of ethane feedstock. As seen in Table 1, the use of 0.8 moles of diluent steam per mole of ethane feedstock improves the resulting ethylene yield by 2.33%.

TABLE 1

| Yield Component (wt percent) | Yields from Ethane Cracking Based on Diluent Steam Addition: 0.8 Moles Diluent Steam Per Mole Ethane | 0.3 Moles Diluent Steam Per Mole Ethane |
|---|---|---|
| Hydrogen | 4.02 | 3.91 |
| Methane | 4.90 | 5.62 |
| Carbon Monoxide | 0.17 | 0.08 |
| Carbon Dioxide | 0.03 | 0.01 |
| Acetylene | 0.55 | 0.39 |
| Ethylene | 51.28 | 50.11 |
| Ethane | 33.36 | 33.38 |
| Methylacetylene | 0.02 | 0.02 |
| Propadiene | 0.01 | 0.01 |
| Propylene | 1.28 | 1.53 |
| Propane | 0.34 | 0.32 |
| Butadiane | 1.39 | 1.33 |
| Butylene | 0.15 | 0.18 |
| Butane | 0.16 | 0.19 |
| Pentane plus | 2.36 | 2.92 |

Thus, the present invention is well adapted to carry out the objects and attain the ends and advantages mentioned above as well as those inherent therein. While presently preferred embodiments have been described for purposes of this disclosure, numerous changes in the arrangement of method steps and apparatus parts can be made by those skilled in the art. Such changes are encompassed within the spirit of this invention as defined by the appended claims.

What is claimed is:

1. A method for pyrolytically cracking a hydrocarbon vapor feedstock in a hydrocarbon pyrolysis unit to produce an olefinic hydrocarbon product, comprising the steps of:

(a) contacting a hydrocarbon vapor feedstock, said hydrocarbon vapor feedstock not being saturated with water vapor, with liquid water while heating said hydrocarbon vapor feedstock and said liquid water by indirect heat exchange whereby at least a portion of said liquid water is vaporized and combined with said hydrocarbon vapor feedstock, said hydrocarbon vapor feedstock flowing countercurrent to said liquid water during step (a); and (b) then, cracking said hydrocarbon vapor feedstock in the presence of said vaporized water in a pyrolysis furnace to produce a furnace effluent stream comprised of an olefinic hydrocarbon product gas and said vaporized water.

2. The method of claim 1 wherein said furnace effluent stream is used to heat said hydrocarbon vapor feedstock and said liquid water by indirect heat exchange in accordance with step (a).

3. The method of claim 1 wherein said hydrocarbon vapor feedstock is contacted with said liquid water in accordance with step (a) and said hydrocarbon vapor feedstock and said liquid water are heated in accordance with step (a) in a contacting vessel containing at least one indirect heat exchanger.

4. The method of claim 3 wherein step (a) further comprises the steps of:

introducing said hydrocarbon vapor feedstock into the lower portion of said contacting vessel so that said hydrocarbon vapor feedstock flows toward the top of said contacting vessel; and introducing said liquid water into the upper portion of said contacting vessel so that said liquid water contacts said hydrocarbon vapor feedstock in accordance with step (a) as said liquid water gravitationally falls toward the bottom of said contacting vessel.

5. The method of claim 4 further comprising the step of distributing said liquid water in said contacting vessel using at least one spray nozzle.

6. The method of claim 4 wherein said hydrocarbon vapor feedstock and said liquid water are heated in said containing vessel in accordance with step (a) by indirect heat exchange with a plurality of process streams.

7. The method of claim 6 wherein one of said process streams is said furnace effluent stream.

8. The method of claim 6 wherein said process streams are used for indirect heat exchange in said contacting vessel such that said hydrocarbon vapor feedstock is sequentially heated by indirect heat exchange with said process streams in order of increasing process stream approach temperature as said hydrocarbon vapor feedstock flows toward the top of said contacting vessel.

9. The method of claim 4 further comprising the steps of:

(c) quenching said furnace effluent stream by contacting with quench water so that said olefinic hydrocarbon product gas and said vaporized water are cooled and at least a portion of said vaporized water is condensed;

(d) recovering unvaporized water from said contacting vessel;

(e) combining said unvaporized water recovered in step (d) with a portion of said quench water used in step (c) and a portion of the water condensed in step (c) to form a combined water stream; and (f) using said combined water stream formed in step (e) for contacting said hydrocarbon vapor feedstock in carrying out step (a).

10. The method of claim 1 wherein said hydrocarbon vapor feedstock comprises ethane, propane, butane, natural gas condensate, or a mixture thereof.

11. The method of claim 10 wherein said olefinic hydrocarbon product comprises ethylene.

* * * * *